United States Patent [19]

Gilbert

[11] Patent Number: 4,527,984

[45] Date of Patent: Jul. 9, 1985

[54] WATER SKIS AND OARING STICKS

[76] Inventor: Serge Gilbert, 355, 20th St., Quebec, Canada, G1L 1Z9

[21] Appl. No.: 606,692

[22] Filed: May 3, 1984

[51] Int. Cl.[3] ..... A63C 15/00

[52] U.S. Cl. ..... 441/76; 441/65; 440/101

[58] Field of Search ..... 441/76, 77, 65, 75, 441/66, 67, 68, 74, 79; 440/98, 101, 102, 104

[56] References Cited

U.S. PATENT DOCUMENTS

| | | | |
|---|---|---|---|
| 2,893,021 | 7/1959 | Lundborg | 441/76 |
| 3,566,427 | 3/1971 | Davis | 441/76 |
| 3,777,324 | 12/1973 | Jenkins | 441/77 |
| 3,952,353 | 4/1976 | Word | 441/76 |

FOREIGN PATENT DOCUMENTS

| | | | |
|---|---|---|---|
| 350191 | 5/1935 | Canada . | |
| 387372 | 3/1940 | Canada . | |
| 443999 | 8/1946 | Canada . | |
| 587879 | 12/1959 | Canada . | |
| 596333 | 4/1960 | Canada . | |
| 917188 | 12/1972 | Canada . | |
| 0026513 | 8/1981 | European Pat. Off. | 441/76 |
| 2604597 | 8/1977 | Fed. Rep. of Germany | 441/101 |
| 2915943 | 11/1980 | Fed. Rep. of Germany | 441/76 |
| 197809 | 9/1978 | France | 441/101 |
| 400436 | 12/1942 | Italy | 441/76 |
| 401368 | 1/1971 | U.S.S.R. | 441/101 |

*Primary Examiner*—Trygve M. Blix
*Assistant Examiner*—C. T. Bartz

[57] ABSTRACT

The invention consists of a pair of water oaring sticks to be used in conjunction with flotation skis to be secured to the feet of a user, in order to facilitate the movement of the latter over aqueous surfaces. Each stick comprises a fixed or telescopically-extendable pole, having a handle mounted at one end and a float member at the other end to which an inclined paddle is secured. The float member acts as a reaction member when pushing on the stick; it also prevents the sinking of the stick should the latter slip from the hand of the user. The bottom surface of each floating ski includes rounded ribs, extending downwardly rearwardly therefrom, to thereby constitute a backward movement counteracting trap. Forward movement is made possible by pushing the poles against the water and by the sliding of the skis.

4 Claims, 16 Drawing Figures

P
17
16A
16
16C
16B
11
10
27
18
12
11
20
W 16
19'
18
20'
20

16
15
18
19'
19

14
16"
20'
W
20

WATER SKIS AND OARING STICKS

FIELD OF THE INVENTION

This invention relates to sticks for assisting in the movement over aqueous surfaces, together with corresponding flotation skis.

BACKGROUND OF THE INVENTION

Looking over prior art, there is seen that, except in one instance—Canadian Pat. No. 596,333, issued Apr. 19, 1960 to Lundberg—no water stick is disclosed.

This Canadian patent relates to a water ski pole comprising a blade constituting a sealed flotation chamber. Means are provided to support and connect the forearm of the user to the pole, wherein the hand of the user must grab a pole handle; the forward movement is thus consecutive to a movement of the arm from the front to the rear. Lastly, it is to be noted that the only propulsion means are the poles.

OBJECTS OF THE INVENTION

The gist of the invention is to provide a device which may be used for physical fitness purposes, sporting activities, leisure or work.

Another advantage of the device is that it facilitates access to areas of shallow waters.

A further object of the device is that the balance obtained by the sticks is most noteworthy even in wavy waters having one to two feet waves.

A still further object of the invention is to provide a device for easy and safe operation on water.

SUMMARY OF THE INVENTION

Each water oar stick of the present invention includes a single handle, a float member and a propulsive paddle distinct from the float member. Forward movement is produced both by the poles and by the skis, and the forward motion is initiated by pushing on the poles downwardly and rearwardly.

The flotation skis according to the present invention comprise on the bottom surface thereof ribs defining backward movement counter-acting traps. The user stands on the skis and uses the sticks to keep his equilibrium. These sticks permit forward motion, thanks to the predetermined inclined plane of the paddle at the lower end thereof.

The skis and sticks of the invention can be used for a variety of work assignments, leisure or sporting activities.

DETAILED DESCRIPTION OF THE EMBODIMENTS OF THE INVENTION

Figure 1:
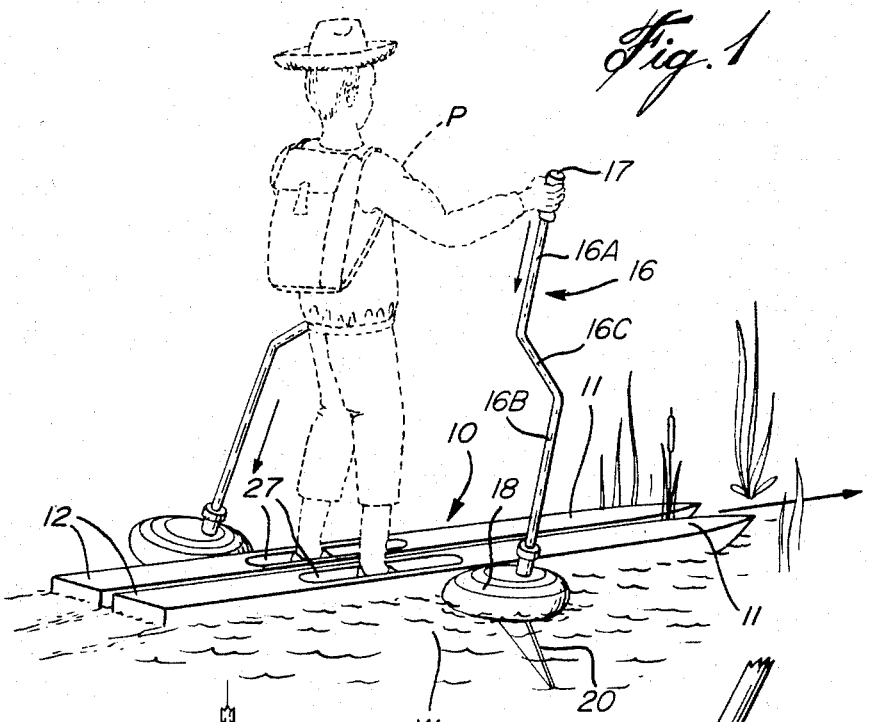
FIG. 1 is a perspective view of the skis and water oar sticks used in shallow water by a person shown in phantom lines.

The invention comprises a pair of flotation skis 10, of given dimensions, for example having a length of six feet, a width of one foot and a height of seven inches. Skis 10 have a forward tip 11 and a rearward slightly-inclined end 12. The ski shell 13 is preferably made of plastic or fiberglass, with foam 14 therewithin. Skis 10 are accompanied by water car sticks 15, preferably comprising a pole 16, with a handle 17 mounted at one end thereof and a float member 18 secured at the other end thereof. Preferably, the float member will have the following dimensions: a width of 10 inches, a length of 14 inches and a height of 6 inches.

Figure 8:
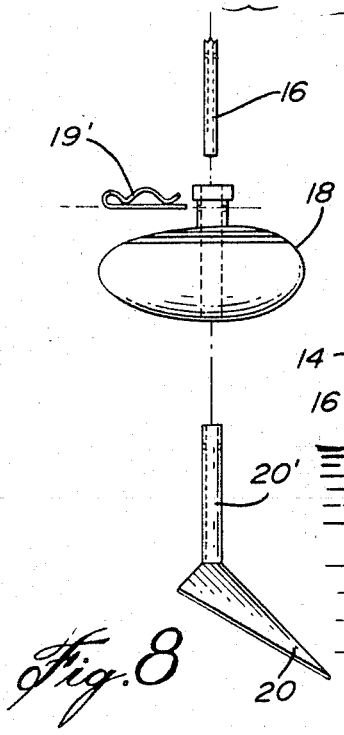
FIG. 8 is an exploded view of the water oar stick.
Figure 7:
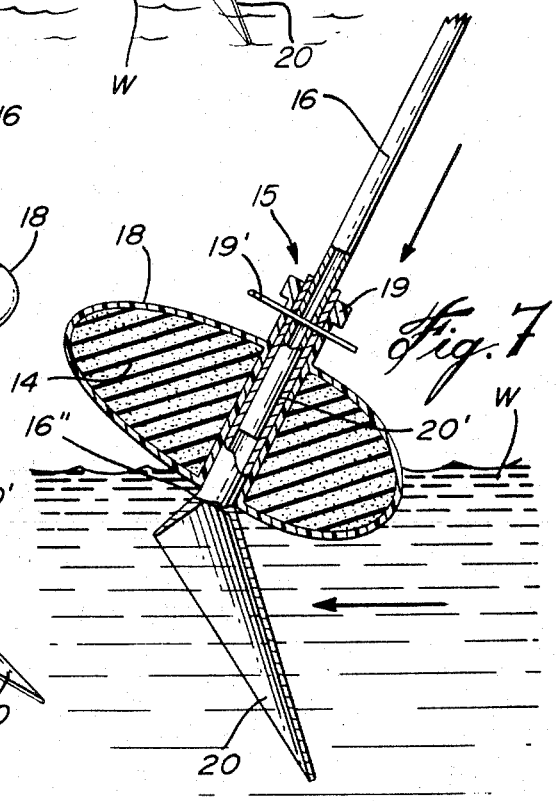
FIG. 7 is a cross-section of the float member and of the paddle but at a 90-degree angle from that of FIG. 6.
Figure 2:
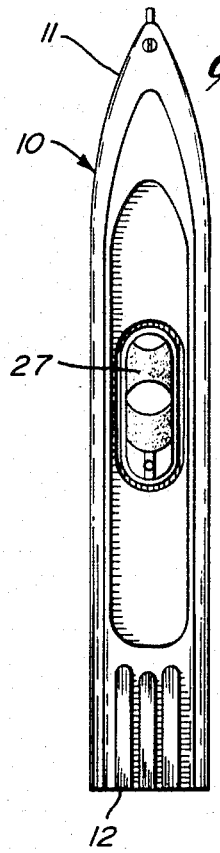
FIGS. 2 and 3 are top and bottom plan views of the ski showing the keel thereof extending along the length of the ski and narrowing in the front portion.
Figure 3:
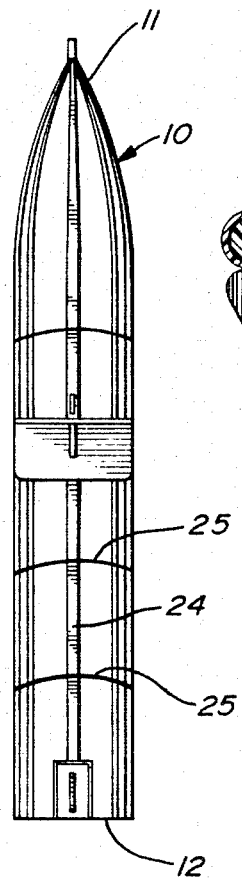

As shown in FIGS. 7 and 8, float member 18 has an integral sleeve 19 in which is slidably inserted the tube 20° of a paddle 20. Pole 16 is inserted in tube 20'. Pole 16, float member 18 and paddle 20 are releasably interconnected by a spring clip 19'.

Paddle 20 is preferably of triangular shape and transversely curved. It is located under float member 18 and proximate thereto. This paddle is forwardly inclined relative to the axis of pole 16, with an angle of, preferably, 45 degrees.

Each of the skis 10 includes on its bottom surface a keel 24, which extends along the ski and narrowing at the front portion thereof, and a tail fin 24' and a backward movement counter-acting apparatus, the latter being constituted of ribs 25 of curved shape transversely of skis 10. Ribs 25 preferably have a height relative to the bottom surface of ski 10 of at least $1\frac{1}{2}$ inch. These ribs 25 define backward movement counter-acting traps 26, of L-shape, which open downwardly rearwardly of skis 10.

The top surface of skis 10 includes conventional means for connecting the skis to the feet of a user P, as indicated by 27, installed thereto. Hence, the user P may move forwardly on water W with skis 10 and sticks 15 by following the teachings of the cross-country skiing movement, advance and balance being facilitated by said sticks 15.

The user P inclines his sticks forwardly and pushes rearwardly. The paddle 20 becomes approximately vertical: the float member 18 is used as an abutment point againt the sinking in water of the paddle, and the paddle 20 as an abutment point against rearward motion.

Figure 9:
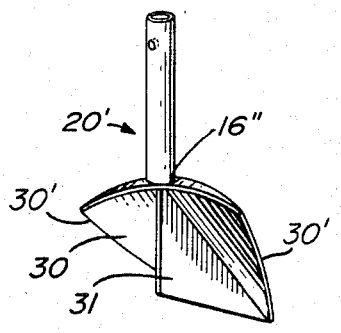
FIGS. 9 to 11 are a perspective, a front view and a side view, respectively, of the paddle assembly in accordance with a second embodiment.
Figure 10:
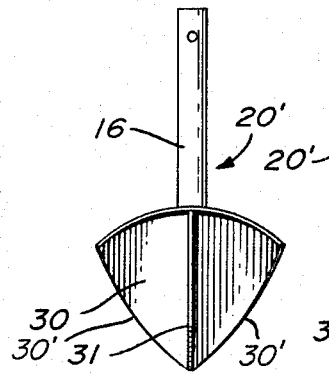
Figure 11:
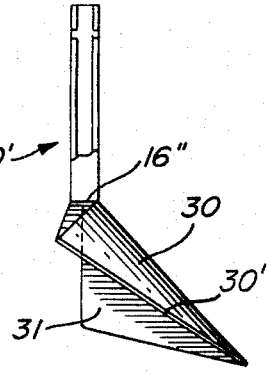

In another embodiment of the paddle, in FIGS. 9 to 11 at 20', there is disclosed a shovel-like paddle 30 in the general shape of an isosceles triangle and which is transversely curved and forwardly inclined as paddle 20, defining a convex upstream surface and a concave downstream surface. A triangular plate-like keel 31 extends centrally of and downstream from the paddle concave surface in a plane containing at least the lower straight portion of pole 16. The keel 31 permits a better directional control of the stick as it extends downstream from the side edges 30' of paddle 30

Figure 12:
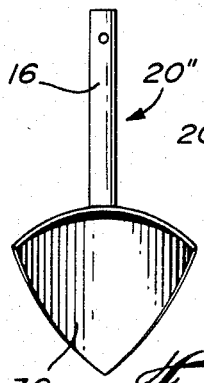
FIGS. 12 to 14 are a front view, side view and a back view, respectively, of a third embodiment of the paddle assembly.
Figure 13:
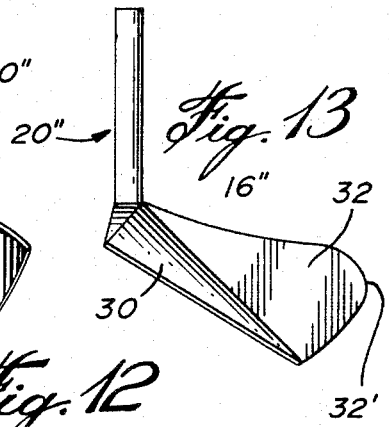
Figure 14:
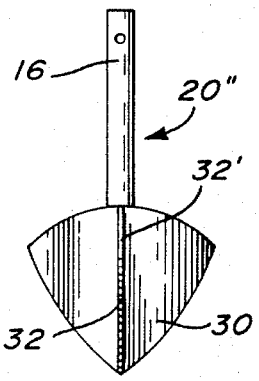

In yet another embodiment of the paddle, in FIGS. 12 to 14 at 20'', there is shown paddle 30, to the center of the convex side of which is fixed a plate 32 which extends along the axis defined by pole 16. Plate 32 has a rounded outer end 32'. Paddle assembly 20'' provides improved directional control.

Figure 15:
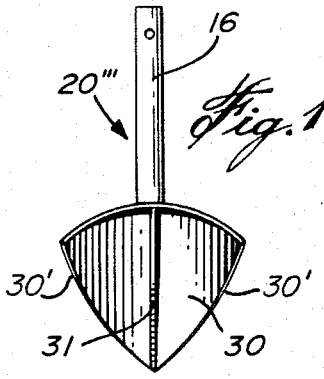
FIGS. 15 and 16 are a front view and a back view, respectively, of a fourth embodiment of the paddle assembly.
Figure 16:
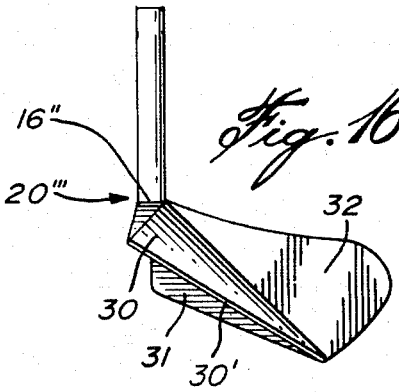

In still another embodiment of the paddle, in FIGS. 15, 16 at 20''', the features of paddle assemblies 20' and 20'' are combined, so as to obtain a still better directional control of the stick.

Figure 6:
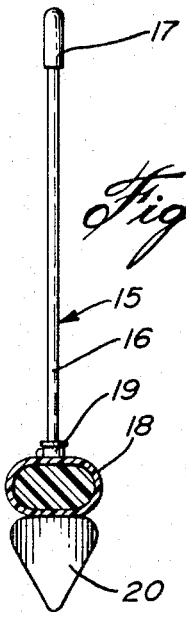
FIG. 6 is a front elevation of the water oar stick of FIG. 5 but showing the float member in cross-section.
Figure 5:
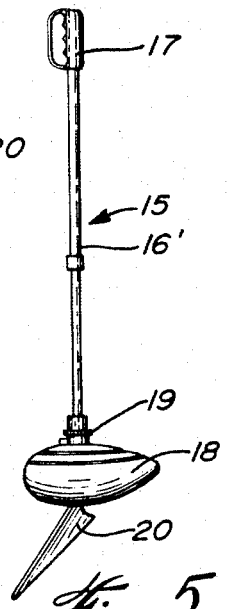
FIG. 5 is a side elevation of a water oar stick, wherein the paddle thereof is inclined at a 45-degree angle.
Figure 4:
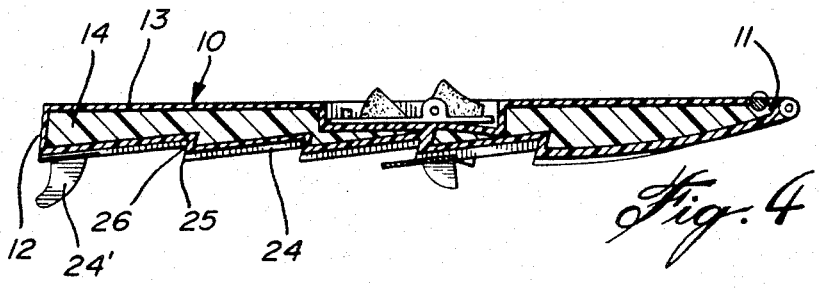
FIG. 4 is a longitudinal sectional view of the ski of FIG. 2.

Poles 16 may be straight and telescopic, as shown at 16' in FIGS. 5 and 6. For better handling, due to the width of skis 10 and float members 18, the poles 16 each consist, as shown in FIG. 1, of parallel straight upper and lower offset portions 16A and 16B, respectively, interconnected by an intermediate inclined portion 16C, the resulting offset being perpendicular to the plane of keel 31.

What I claim is:

1. A pair of water oar sticks for use as propulsion means with a pair of flotation skis, each of said sticks comprising an elongated pole having a handle at its upper end, a paddle secured to its lower end and a float member fixedly connected to said pole proximate said paddle and intermediate the latter and said handle, said paddle being a generally isosceles triangular plate having its two equal side edges converging toward a point which is the lowest point of the paddle, said paddle having a straight cross-section when taken in a plane containing said point of said plate and the longitudinal axis of at least the lower portion of said pole, said paddle being curved transverse of said axis to define a concave downstream surface and a convex upstream surface, said paddle being further inclined in an upstream direction at about 45 degrees relative to said axis, and further including a generally triangular plate-like keel extending downstream from said concave surface, beyond said side edges and lying in said plane to provide directional control of said stick.

2. The water oar sticks as defined in claim 1, further including an additional triangular plate-like keel extending in the upstream direction from said convex surface and co-planar with said first-named keel.

3. The water oar sticks as defined in claim 1, wherein said pole includes parallel, straight upper and lower end portions and an intermediate inclined portion joining said upper and lower end portions, whereby the latter are relatively offset, said offset being in a plane generally perpendicular to the plane containing said keel.

4. Water oar sticks as defined in claim 1, wherein said float member is of oval shape, with the greater axis of said oval shape in a plane containing said keel, and wherein said pole, float member and paddle are releasably interconnected.

* * * * *